US008132683B2

(12) United States Patent
Rund et al.

(10) Patent No.: US 8,132,683 B2
(45) Date of Patent: Mar. 13, 2012

(54) PROTECTIVE BOTTLE SLING

(75) Inventors: Derek Berton Rund, Centerville, OH (US); Dennis Lee Davis, Springfield, OH (US)

(73) Assignee: Evenflo Company, Inc., Miamisburg, OH (US)

( * ) Notice: Subject to any disclaimer, the term of this patent is extended or adjusted under 35 U.S.C. 154(b) by 295 days.

(21) Appl. No.: 12/454,177

(22) Filed: May 13, 2009

(65) Prior Publication Data

US 2010/0288719 A1 Nov. 18, 2010

(51) Int. Cl.
*A61J 9/08* (2006.01)
*B65D 23/08* (2006.01)

(52) U.S. Cl. ..... 215/11.6; 215/386; 206/446; 220/737; 224/148.6; 248/102

(58) Field of Classification Search ..... 215/11.6, 215/12.1, 13.1, 286, 395, 386; 248/102; 294/27.1, 33; 229/89–91; 206/148.15, 168, 206/446; 224/148.6, 48.1; 220/737
See application file for complete search history.

(56) References Cited

U.S. PATENT DOCUMENTS

| | | | | | |
|---|---|---|---|---|---|
| 596,304 | A | * | 12/1897 | Paquette | 215/12.1 |
| 747,025 | A | * | 12/1903 | White | 215/11.6 |
| 1,188,904 | A | * | 6/1916 | Cosgriff | 215/12.1 |
| 1,274,631 | A | * | 8/1918 | Tillmann | 217/122 |
| 1,462,291 | A | * | 7/1923 | McCrink | 215/11.6 |
| 1,690,509 | A | * | 11/1928 | Thoreson et al. | 215/11.6 |
| 2,331,085 | A | * | 10/1943 | Sterling | 229/89 |
| 2,654,474 | A | * | 10/1953 | Ringler | 206/158 |
| 2,745,569 | A | | 5/1956 | Seaman | |
| 2,838,226 | A | * | 6/1958 | Hartmann et al. | 229/90 |
| 3,567,059 | A | | 3/1971 | Littman | |
| 3,620,491 | A | | 11/1971 | Baclit | |
| 3,680,726 | A | | 8/1972 | Massey | |
| 3,718,360 | A | | 2/1973 | Knutzen | |
| 3,729,859 | A | | 5/1973 | Smith, III et al. | |
| 3,765,453 | A | | 10/1973 | Parkinson | |
| 3,768,156 | A | | 10/1973 | Caird et al. | |
| 3,825,142 | A | * | 7/1974 | Campagna | 215/12.2 |
| 3,967,333 | A | | 7/1976 | Boyd | |
| 3,993,274 | A | | 11/1976 | Jansen | |
| 4,076,139 | A | | 2/1978 | Larson | |
| 4,228,908 | A | | 10/1980 | Tweeton | |
| 4,296,902 | A | | 10/1981 | Dachtler | |

(Continued)

FOREIGN PATENT DOCUMENTS

EP 964653 A1 12/1999

(Continued)

OTHER PUBLICATIONS

Unknown, http://www.gmmarketing.com/Bottle%20Sleeves.jpg, downloaded Feb. 7, 2008.

(Continued)

*Primary Examiner* — Sue Weaver
(74) *Attorney, Agent, or Firm* — Taft Stettinius & Hollister LLP

(57) ABSTRACT

A sling-type protective cover for a container. An exemplary protective sling for a baby bottle may include a plurality of straps extending longitudinally from a base. The bottom end of a baby bottle may be received in the base, and each of the straps may include an opening for engaging the neck of the bottle. The protective sling may be constructed from an elastic material, such as a thermoplastic elastomer.

17 Claims, 5 Drawing Sheets

U.S. PATENT DOCUMENTS 4,390,095 A * 6/1983 Cunningham ..... 206/150
4,545,491 A 10/1985 Bisgaard et al.
4,564,957 A 1/1986 Scharf
D289,260 S 4/1987 Weckman
4,684,672 A 8/1987 Buchanan et al.
4,726,551 A 2/1988 Randall et al.
4,748,903 A 6/1988 Fereshetian
4,777,087 A 10/1988 Heeks et al.
4,798,671 A 1/1989 Mijers et al.
4,815,615 A 3/1989 Phlaphongphanich
4,832,213 A 5/1989 Sharon et al.
4,909,249 A 3/1990 Akkas et al.
4,925,895 A 5/1990 Heeks et al.
4,973,504 A 11/1990 Romberg et al.
4,986,827 A 1/1991 Akkas et al.
4,989,811 A 2/1991 Millis et al.
5,000,994 A 3/1991 Romberg et al.
5,016,845 A 5/1991 Pellegrino
5,019,035 A 5/1991 Missirlian et al.
5,027,838 A 7/1991 Iaia et al.
5,067,328 A 11/1991 Medina et al.
5,078,287 A 1/1992 Holmes, III
5,133,098 A 7/1992 Weber
5,166,031 A 11/1992 Badesha et al.
5,183,229 A 2/1993 Duggan
5,184,796 A 2/1993 Maher
5,192,041 A 3/1993 Bryant
5,269,368 A 12/1993 Schneider et al.
5,370,931 A 12/1994 Fratangelo et al.
5,383,906 A 1/1995 Burchett et al.
5,408,068 A 4/1995 Ng
5,419,427 A 5/1995 Wurgler
5,423,982 A 6/1995 Jungbauer et al.
5,480,938 A 1/1996 Badesha et al.
5,538,211 A 7/1996 Dewey et al.
5,542,526 A 8/1996 Wurgler
5,558,200 A 9/1996 Whitby et al.
5,573,153 A 11/1996 Stillman
D377,741 S 2/1997 Bennett et al.
5,609,759 A 3/1997 Nohren, Jr. et al.
5,624,048 A * 4/1997 Sander et al. ..... 215/395
5,624,090 A 4/1997 Gammelgaard
5,632,420 A 5/1997 Lohrman et al.
5,635,232 A 6/1997 Wallace
5,638,968 A 6/1997 Baron et al.
5,664,746 A 9/1997 Benzakarya
5,692,257 A 12/1997 Albertieri
5,718,676 A 2/1998 Barrett
5,727,842 A 3/1998 O'Neil
5,762,996 A 6/1998 Lucas et al.
5,795,332 A 8/1998 Lucas et al.
5,809,867 A 9/1998 Turner et al.
5,820,084 A 10/1998 Trumbauer et al.
5,871,184 A 2/1999 Kaopio
5,873,551 A 2/1999 Jones
5,917,167 A 6/1999 Bestel
5,927,524 A 7/1999 Miller
5,927,661 A 7/1999 Tinsley et al.
5,935,096 A 8/1999 Barrett
5,941,437 A 8/1999 Okumura
5,960,971 A 10/1999 Bral
5,989,209 A 11/1999 Barrett
6,000,664 A 12/1999 Hood
6,003,821 A 12/1999 Fabian et al.
6,019,245 A 2/2000 Foster et al.
6,079,316 A 6/2000 Barden et al.
6,082,681 A 7/2000 Rand
6,089,418 A 7/2000 Gaiser et al.
6,098,934 A 8/2000 Skelton
6,138,847 A 10/2000 Johnson
6,158,870 A 12/2000 Ramirez
6,210,352 B1 4/2001 Williams et al.
6,221,447 B1 4/2001 Munn et al.
6,295,681 B1 10/2001 Dolah
6,295,920 B1 10/2001 Barden et al.
6,334,231 B2 1/2002 Safieh
6,355,024 B1 3/2002 Small et al.
6,398,766 B1 6/2002 Branch
6,410,896 B2 6/2002 Witonsky et al.
6,417,498 B1 7/2002 Shields et al.
6,458,346 B1 10/2002 Howett et al.
6,464,100 B2 10/2002 Canfield
6,468,261 B1 10/2002 Small et al.
6,523,711 B1 2/2003 Hughes et al.
6,523,792 B2 2/2003 Fishler
6,592,084 B1 7/2003 Nile
6,599,271 B1 7/2003 Easley
6,607,087 B2 8/2003 Turnwald
6,623,455 B2 9/2003 Small et al.
6,635,242 B2 10/2003 Howett et al.
6,641,094 B2 11/2003 Fishler
6,703,590 B1 3/2004 Holley, Jr.
6,719,138 B2 4/2004 Austin et al.
6,772,891 B1 8/2004 Song
6,824,112 B2 11/2004 Lange
6,844,409 B2 1/2005 Angeletakis et al.
6,871,751 B2 3/2005 Kerns et al.
6,920,991 B2 7/2005 Holley, Jr.
6,921,880 B2 7/2005 Berger
D509,433 S 9/2005 Trayser et al.
6,946,172 B2 9/2005 Munn et al.
6,954,942 B2 10/2005 Austin
6,961,961 B1 11/2005 Ezra
6,972,309 B1 12/2005 Wideman et al.
6,984,688 B2 1/2006 Gu
6,991,126 B2 1/2006 Jackel
7,012,541 B2 3/2006 Ibguy
7,032,248 B1 4/2006 Gutilla
7,060,769 B2 6/2006 Angeletakis
7,060,770 B2 6/2006 Angeletakis
7,150,354 B2 12/2006 Snell
7,152,750 B2 12/2006 Coffey
7,173,097 B2 2/2007 Angeletakis
7,196,293 B2 3/2007 Britto
7,208,549 B2 4/2007 Wideman et al.
D547,875 S 7/2007 Pillado
7,287,386 B2 10/2007 Upadhye et al.
7,316,035 B2 1/2008 Archambault
7,318,656 B1 1/2008 Merine
7,467,729 B2 * 12/2008 Lown et al. ..... 220/739
2001/0008238 A1 7/2001 Witonsky et al.
2001/0009048 A1 7/2001 Safieh
2001/0009994 A1 7/2001 Small et al.
2001/0012549 A1 8/2001 Munn et al.
2001/0035387 A1 11/2001 Sutcliffe-Noyd
2002/0088768 A1 7/2002 Turnwald
2002/0104933 A1 8/2002 Fishler
2002/0134746 A1 9/2002 Reidenbach
2002/0162816 A1 11/2002 Walsh
2002/0190079 A1 12/2002 Hamamoto
2003/0015630 A1 1/2003 Fishler
2003/0108509 A1 6/2003 Howett et al.
2003/0141268 A1 7/2003 Kerns et al.
2003/0173491 A1 9/2003 Ibguy
2003/0183595 A1 10/2003 Huang
2003/0191418 A1 10/2003 Pillari
2003/0212233 A1 11/2003 Angeletakis et al.
2003/0218105 A1 11/2003 Sones et al.
2004/0035985 A1 2/2004 Fishler
2004/0061031 A1 4/2004 Lange
2004/0094499 A1 5/2004 Huang
2004/0178163 A1 9/2004 Kerns et al.
2004/0188371 A1 9/2004 Holley, Jr.
2004/0194470 A1 10/2004 Upadhye et al.
2004/0217102 A1 11/2004 Berger
2004/0225072 A1 11/2004 Angeletakis
2004/0225073 A1 11/2004 Angeletakis
2004/0230017 A1 11/2004 Kerns et al.
2004/0238540 A1 12/2004 Jackel et al.
2004/0254320 A1 12/2004 Angeletakis
2005/0061814 A1 3/2005 Jackel
2005/0072818 A1 4/2005 Howard
2005/0118239 A1 6/2005 Sabesan
2005/0132462 A1 6/2005 Archambault
2005/0143701 A1 6/2005 Snell
2005/0154361 A1 7/2005 Sabesan
2005/0178412 A1 8/2005 Koch et al.

| | | | |
|---|---|---|---|
| 2005/0186514 | A1 | 8/2005 | French et al. |
| 2005/0238341 | A1 | 10/2005 | Thaler et al. |
| 2005/0242770 | A1 | 11/2005 | Britto |
| 2005/0282968 | A1 | 12/2005 | Wideman et al. |
| 2005/0282970 | A1 | 12/2005 | Wideman et al. |
| 2005/0288535 | A1 | 12/2005 | Wheland et al. |
| 2006/0078656 | A1 | 4/2006 | Manning et al. |
| 2006/0083710 | A1 | 4/2006 | Joerger et al. |
| 2006/0102810 | A1 | 5/2006 | Banks |
| 2006/0113270 | A1 | 6/2006 | Rea |
| 2006/0162341 | A1 | 7/2006 | Milazzo |
| 2006/0163301 | A1 | 7/2006 | Rhodes et al. |
| 2006/0177489 | A1 | 8/2006 | Massouda et al. |
| 2006/0241257 | A1 | 10/2006 | Angeletakis |
| 2006/0263237 | A1 | 11/2006 | Holley, Jr. |
| 2006/0266667 | A1 | 11/2006 | Mendenhall et al. |
| 2006/0273059 | A1 | 12/2006 | Mendenhall et al. |
| 2006/0278598 | A1 | 12/2006 | Song |
| 2006/0283205 | A1 | 12/2006 | Carriere |
| 2007/0053855 | A1 | 3/2007 | Shelton et al. |
| 2007/0061939 | A1 | 3/2007 | Rose |
| 2007/0062994 | A1 | 3/2007 | Shoemaker et al. |
| 2007/0068890 | A1 | 3/2007 | Rohrig |
| 2007/0125725 | A1 | 6/2007 | Kemper et al. |
| 2007/0148409 | A1 | 6/2007 | Rios et al. |
| 2007/0193651 | A1 | 8/2007 | Kauzlarich |
| 2007/0193908 | A1 | 8/2007 | Torchia et al. |
| 2007/0203443 | A1 | 8/2007 | Pillari |
| 2007/0211135 | A1 | 9/2007 | Moreland et al. |
| 2007/0213214 | A1 | 9/2007 | Roth et al. |
| 2007/0228228 | A1 | 10/2007 | Korbonski |
| 2007/0231195 | A1 | 10/2007 | Holley, Jr. |
| 2007/0289982 | A1 | 12/2007 | Mandachescu |
| 2008/0058727 | A1 | 3/2008 | Domash et al. |
| 2008/0081711 | A1 | 4/2008 | Chauvin et al. |
| 2009/0057257 | A1 | 3/2009 | Marcus et al. |

FOREIGN PATENT DOCUMENTS

| | | | |
|---|---|---|---|
| EP | 1685864 | A2 | 8/2006 |
| EP | 1810707 | A1 | 7/2007 |
| EP | 1872768 | A2 | 1/2008 |
| WO | WO 00/16673 | | 3/2000 |
| WO | WO 00/21484 | | 4/2000 |
| WO | WO 01/03757 | A2 | 1/2001 |
| WO | WO 02/088247 | A2 | 11/2002 |
| WO | WO 02/088254 | A1 | 11/2002 |
| WO | WO 03/093351 | A1 | 11/2003 |

OTHER PUBLICATIONS

Natural Family Living Blog, http://www.naturemoms.com/blog/2007/11/30/bpa-and-glass-baby-bottles-siliskin-and-wee..., downloaded Feb. 4, 2008.

* cited by examiner

PROTECTIVE BOTTLE SLING

BACKGROUND

The present disclosure is directed to covers for containers and, more particularly, to protective covers for beverage containers, such as baby bottles.

SUMMARY

Exemplary embodiments may include sling-type protective covers for containers. An exemplary protective sling for a baby bottle may include a plurality of straps extending longitudinally from a base. The bottom end of the baby bottle may be received in the base, and each of the straps may include an opening for engaging the neck of the bottle. The protective sling may be constructed from an elastic material, such as a thermoplastic elastomer.

In an aspect, a protective sling for a bottle may include a first extension including a first end and a second end, the first end including an opening for receiving a neck of a bottle; a second extension including a first end and a second end, the first end including an opening for receiving the neck of the bottle; and a cup portion for receiving an end of a bottle, the second end of the first extension and the second end of the second extension joining the cup portion.

In a detailed embodiment, the first extension, the second extension, and the cup portion may be integrally formed of a substantially elastic material. In a detailed embodiment, The substantially elastic material may include a thermoplastic elastomer.

In a detailed embodiment, when the protective sling is installed on the bottle, one of the first end of the first extension and the first end of the second extension may overlap the other of the first end of the first extension and the first end of the second extension about the neck of the bottle. In a detailed embodiment, a protective sling may include a third extension including a first end and a second end, the first end including an opening for receiving the bottle neck, and the second end joining the cup portion. In a detailed embodiment, a protective sling may include at least one surface feature on an exterior surface of at least one of the first extension and the second extension. In a detailed embodiment, the first extension and the second extension may be separate for a majority of the length of the bottle.

In an aspect, a removable protective device for a bottle may include at least two substantially longitudinally extending extensions, each of the extensions including a first end and a second end. The second ends may connect to form a bottle-receiving cup for engaging a bottom end surface of a bottle, the first ends may extend longitudinally upward from the cup for substantially a length of the bottle, and each of the first ends may include an opening for at least partially circumscribing a neck of the bottle.

In a detailed embodiment, when the protective device is installed on a bottle, one of the first end of the first extension and the first end of the second extension may overlap the other of the first end of the first extension and the first end of the second extension. In a detailed embodiment, each of the extensions may be separate from the other extensions for a majority of its length. In a detailed embodiment, each of the extensions may be separate from the other extensions for substantially its entire length, and the extensions may be horizontally interposed by at least one generally U-shaped cutout. In a detailed embodiment, a protective device may include at least one surface feature on an exterior surface of at least one of the extensions.

In an aspect, a protective cover for a bottle may include a base for receiving a bottom portion of a bottle; a first strap extending longitudinally from the base, the first strap including a distal end for engaging a neck portion of the bottle; and a second strap extending longitudinally from the base, the second strap including a distal end for engaging the neck portion of the bottle. The first strap and the second strap may be unconnected for a majority of a length of the bottle.

In a detailed embodiment, the first strap, the second strap, and the base may be constructed from at least one of a thermoplastic elastomer and silicone. In a detailed embodiment, the distal end of the first strap and the distal end of the second strap may each include an opening, and, when the protective cover is installed on a bottle, one of the distal end of the first extension and the distal end of the second extension may overlap the other of the distal end of the first extension and the distal end of the second extension. In a detailed embodiment, at least one of the openings may be at least partially circumscribed by an enlarged rim. In a detailed embodiment, the first strap, the first strap distal end, the second strap, the second strap distal end, and the base may be integrally formed of a substantially elastic material. In a detailed embodiment, the distal end of the first strap and the distal end of the second strap may each include an opening for receiving the neck of the bottle, and, when the protective cover is installed on the bottle, each of the distal end of the first strap and the distal end of the second strap may substantially circumscribe the neck of the bottle. In a detailed embodiment, a protective cover may include at least one surface feature on an exterior surface of at least one of the first strap and the second strap. In a detailed embodiment, the first strap and the second strap may be interposed by at least one generally U-shaped cutout.

BRIEF DESCRIPTION OF THE DRAWINGS

The detailed description refers to the following figures in which.

DETAILED DESCRIPTION

The present disclosure contemplates that it may be advantageous to at least partially enclose some containers within a protective cover. For example, a protective cover for a glass baby bottle may reduce the risk of breakage and/or may improve a user's grip on the bottle. Although exemplary embodiments are described herein with particular reference to glass baby bottles, it is within the scope of the disclosure to provide a protective cover for use in connection with any container or device which may functionally or aesthetically benefit from such a protective cover.

Figure 1:
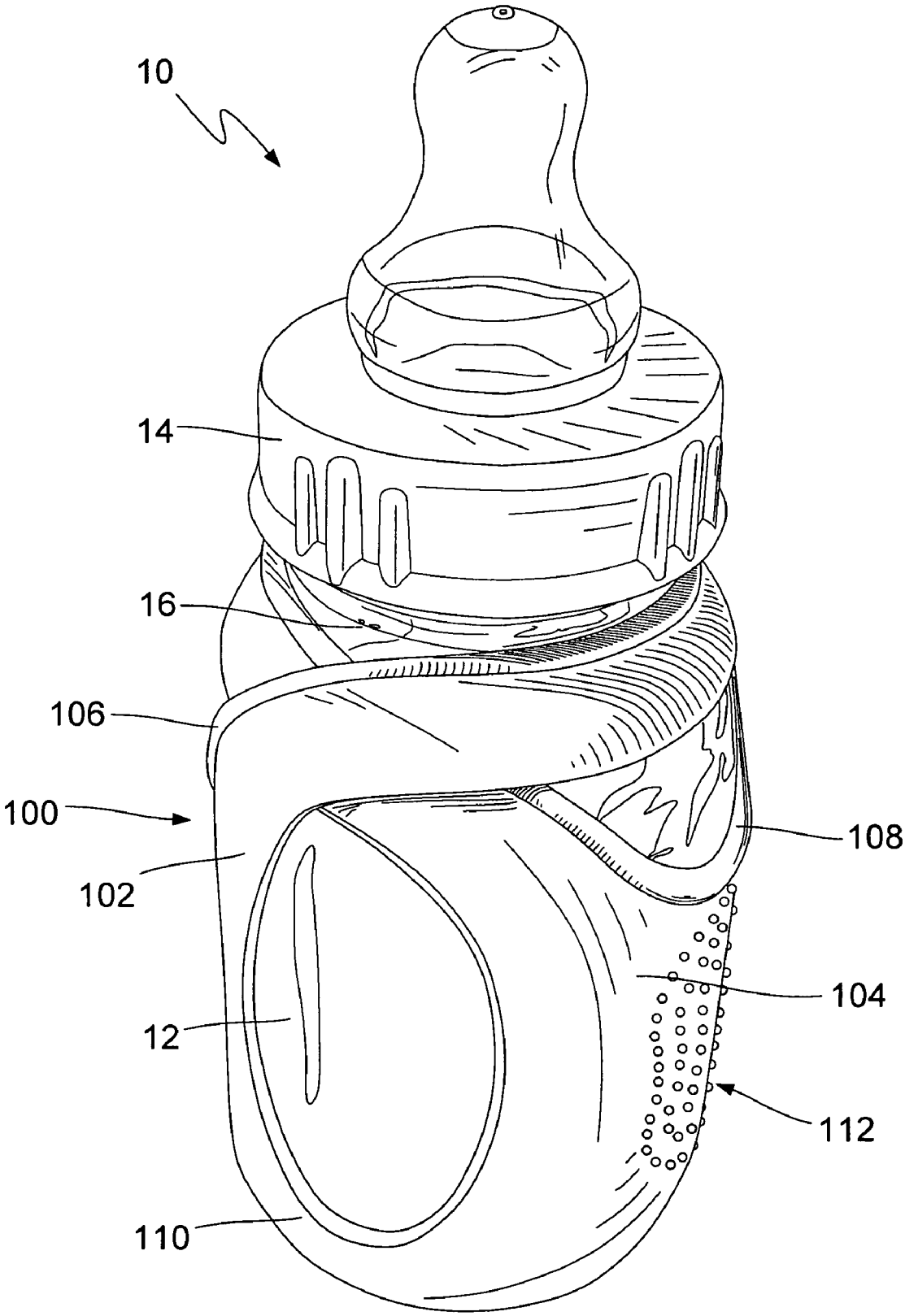
FIG. 1 is a perspective view of an exemplary bottle sling installed on a baby bottle.

FIG. 1 is a perspective view of an exemplary bottle sling 100 installed on a baby bottle 10. The baby bottle 10 may include a body 12 (which may have a circular or polygonal cross section, for example) and a lid 14, which may include a nipple. The body 12 and the lid 14 may be interposed by a narrowed portion or neck 16. An exemplary bottle sling 100 may be installed on the baby bottle 10 such that at least a portion of the exterior of the baby bottle 10 is covered by the bottle sling 100.

An exemplary bottle sling 100 may include one or more extensions 102, 104. One or more of the extensions 102, 104 may include one or more bottle engaging features, such as openings 106, 108 at the upper ends of the extensions 102, 104. Openings 106, 108 may engage an upper portion of a baby bottle 10, such as neck 16. In some exemplary embodiments, openings 106, 108 may engage the lid 14, or any other upper portion of the baby bottle 10.

Figure 3:
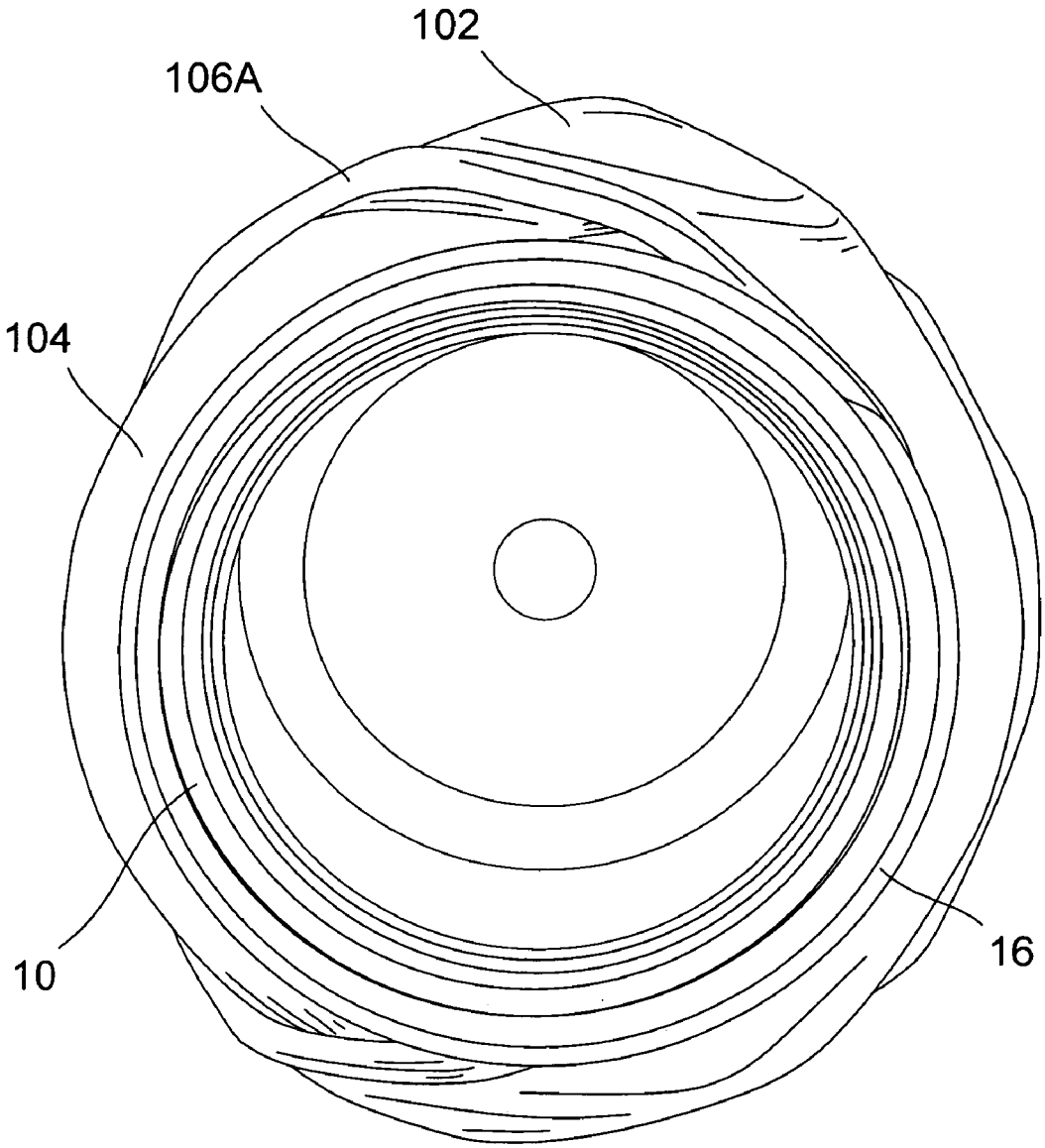
FIG. 3 is a plan view of an exemplary bottle sling installed on a baby bottle.

In an exemplary embodiment, by engaging openings 106, 108 with neck 16, distal portions of individual extensions 102, 104 may at least partially circumscribe at least a portion of bottle 10. As shown in FIG. 3, extensions 102, 104 may at least partially overlap when the bottle sling is installed on a bottle 10.

An exemplary bottle sling may include a base, such as cup portion 110, which may interpose and/or connect the extensions 102, 104. The cup portion may be sized to receive a bottom end of the baby bottle 10. In an exemplary embodiment, the lower surface of the cup portion 10 may be substantially flat (or may include substantially level portions) such that the baby bottle 10 may stand in an upright orientation on a flat horizontal surface.

An exemplary bottle sling 100 may include one or more surface features, such as gripper dots 112, which may improve a user's grip. Some exemplary embodiments may include other surface features (such as lines, patterns, depressions, etc.) in place of or in addition to gripper dots 112. Further, some exemplary embodiments may include one or more openings through one or more of extensions 102, 104. Such openings may contribute to the visual appearance and/or tactile characteristics of the bottle sling 100.

Figure 2:
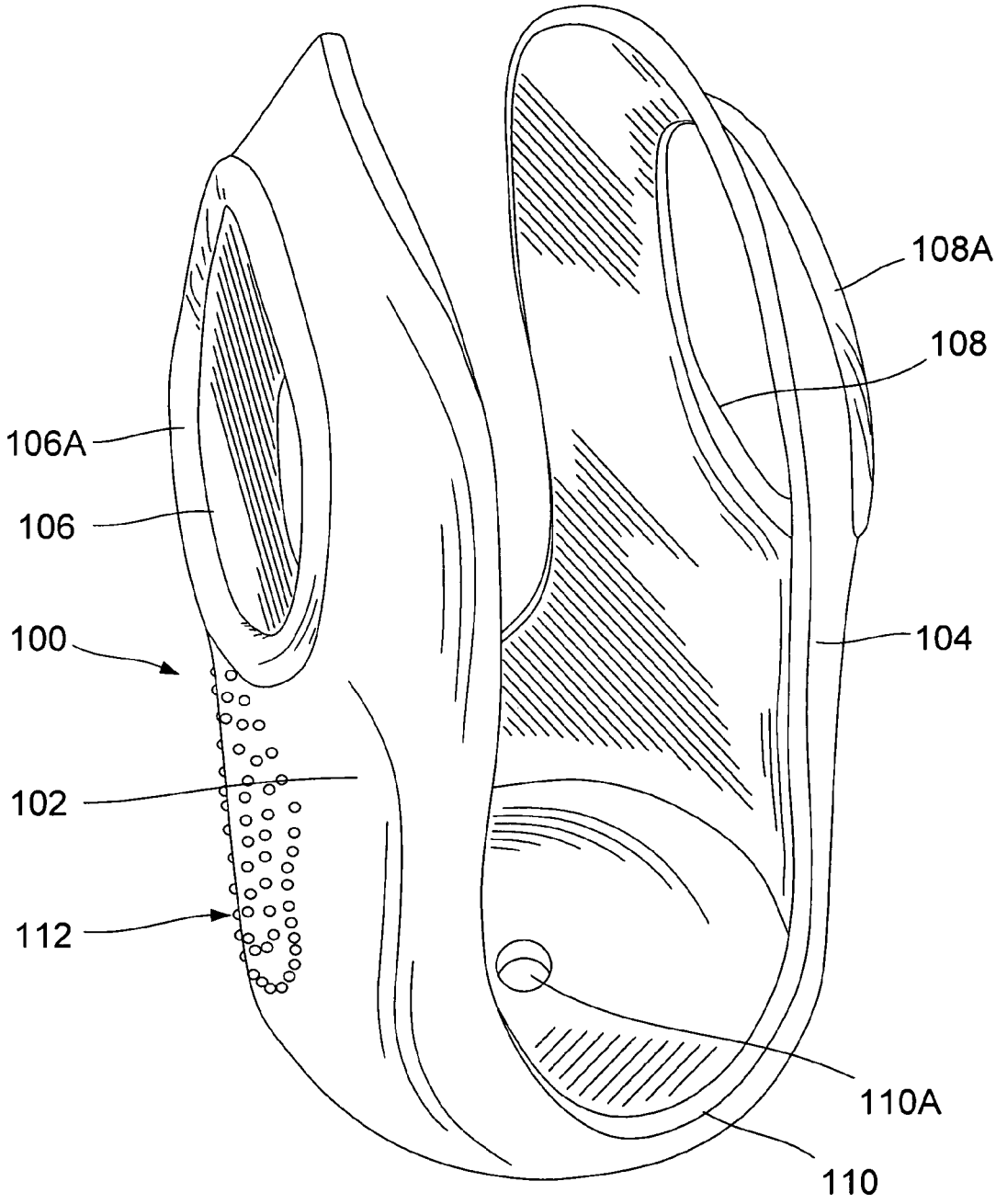
FIG. 2 is a perspective view of an exemplary bottle sling prior to installation on a bottle.

FIG. 2 is a perspective view of an exemplary bottle sling 100 prior to installation on a bottle. Openings 106, 108 may be generally circular, oblong, egg-shaped, or any other shape in a relaxed condition, and may be elastically stretchable to engage neck 16. In some exemplary embodiments, both extensions 102, 104 and their upper ends including openings 106, 108 may be elastically deformed to stretch openings 106, 108 over the neck 16 of the bottle 10.

Figure 4:
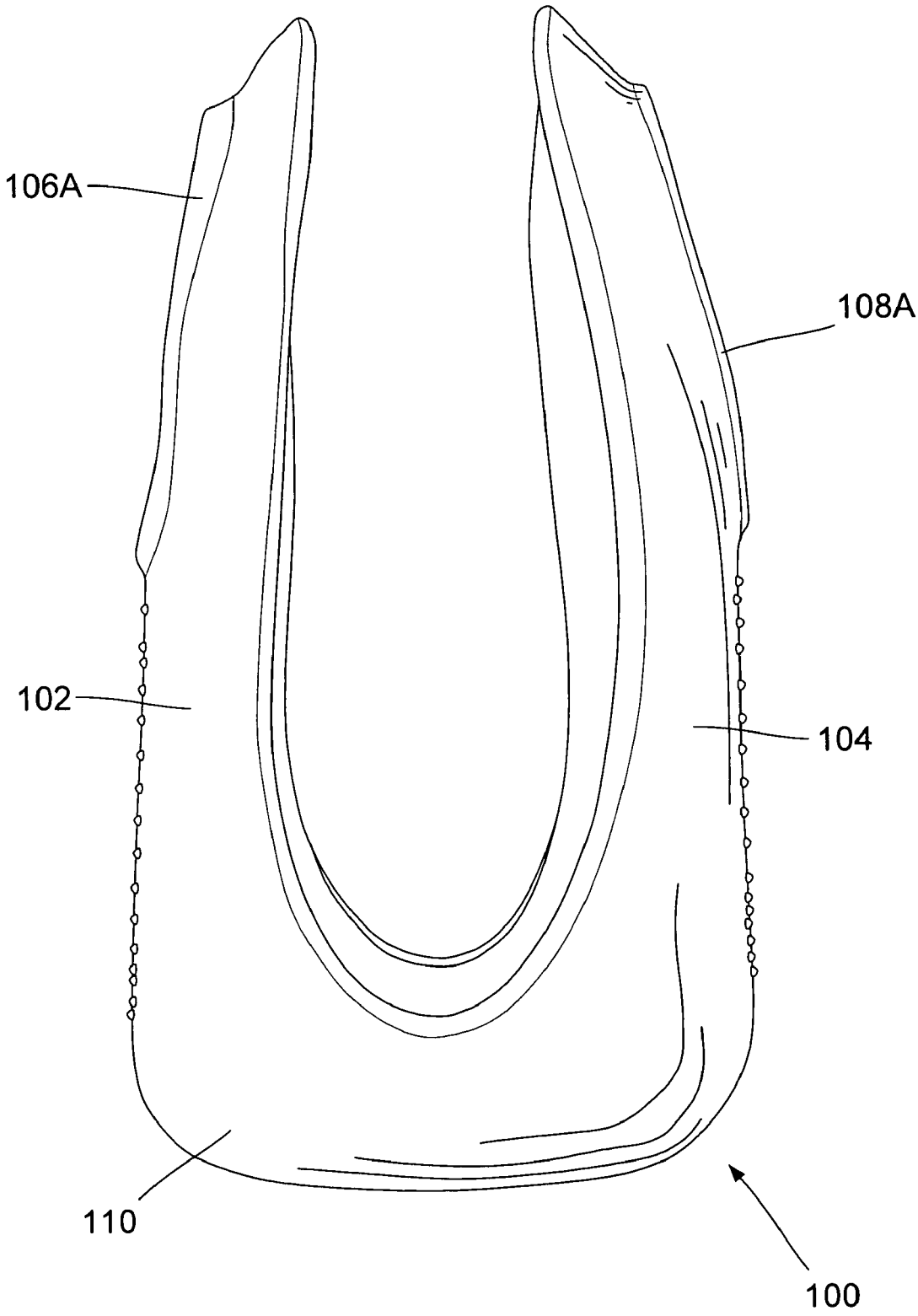
FIG. 4 is a front view of an exemplary bottle sling prior to installation on a bottle.
Figure 5:
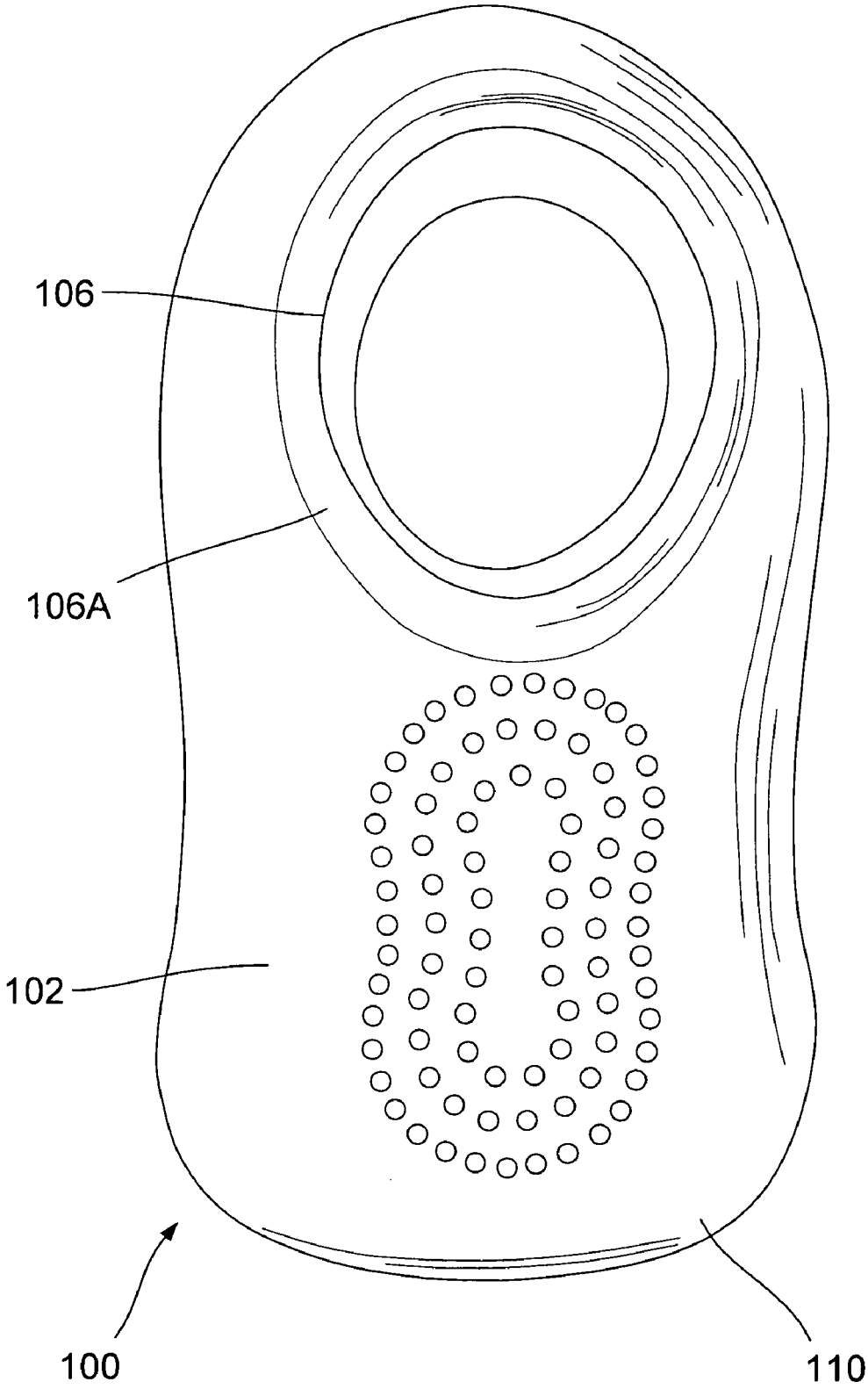
FIG. 5 is a side view of an exemplary bottle sling prior to installation on a bottle.

As shown in FIGS. 2, 4, and 5, extensions 102, 104 may be separate for a majority (and/or substantially all) of their length, and they may be horizontally interposed by generally U-shaped cutouts. The top ends of extensions 102, 104 may be rounded. Openings 106, 108 may be circumscribed by enlarged rims 106A, 108A. Cup portion 110 may include one or more holes 110A, which may prevent a vacuum from being drawn in the cup portion 110 as the bottle sling 10 is removed from a bottle 10.

Some exemplary embodiments may be constructed of a thermoplastic elastomer. For example, an exemplary embodiment may be constructed from a clear or opaque FDA approved thermoplastic elastomer between 30-60 durometer. It is within the scope of this disclosure to construct exemplary embodiments from other materials, such as silicone, rubber, thermoplastic rubber, latex, and the like. Some exemplary embodiments may be constructed of substantially non-toxic or food grade materials.

An exemplary bottle sling 100 may be installed on a baby bottle as follows. The bottom portion of the bottle may be placed within the cup portion 110. Extension 102 may be stretched over the neck 16 of the bottle 10 such that neck 16 is within opening 106. Extension 104 may be stretched over the neck 16 of the bottle 10 such that neck 16 is within opening 108. This may cause the upper ends of extensions 102, 104 to at least partially overlap. In some cases, the lid 14 of the bottle 10 may be removed prior to installing the bottle sling 100, and/or lid 14 may be installed on bottle 10 after installing the bottle sling 100.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages of the may exist even though they may not have been explicitly discussed herein.

What is claimed is:

1. A protective sling for a bottle, comprising:

a first extension including a first end and a second end, the first end including an opening for receiving a neck of a bottle;

a second extension including a first end and a second end, the first end including an opening for receiving the neck of the bottle;

a cup portion for receiving an end of a bottle, the second end of the first extension and the second end of the second extension joining the cup portion; and wherein the first extension, the second extension, and the cup portion are integrally formed of a substantially elastic material.

2. The protective sling of claim 1, wherein the substantially elastic material comprises at least one of a thermoplastic elastomer, silicone, rubber thermoplastic rubber, and latex.

3. The protective sling of claim 1, wherein, when installed on the bottle, one of the first end of the first extension and the first end of the second extension overlaps the other of the first end of the first extension and the first end of the second extension about the neck of the bottle.

4. The protective sling of claim 1, further comprising at least one surface feature on an exterior surface of at least one of the first extension and the second extension.

5. The protective sling of claim 1, wherein the first extension and the second extension are separate for a majority of the length of the bottle.

6. A removable protective device for a bottle, the protective device comprising:

at least two substantially longitudinally extending extensions, each of the extensions including a first end and a second end;

wherein the second ends connect to form a bottle-receiving cup for engaging a bottom end surface of a bottle;

wherein the first ends extend longitudinally upward from the cup for substantially a length of the bottle;

wherein each of the first ends includes an opening for at least partially circumscribing a neck of the bottle; and wherein said at least two substantially longitudinally extending extensions and the bottle-receiving cup are integrally formed of a substantially elastic material.

7. The protective device of claim 6, wherein, when installed on a bottle, one of the first end of the first extension and the first end of the second extension overlaps the other of the first end of the first extension and the first end of the second extension.

8. The protective device of claim 6, wherein each of the extensions is separate from the other extensions for a majority of its length.

9. The protective device of claim 6, wherein each of the extensions is separate from the other extensions for substantially its entire length; and wherein the extensions are horizontally interposed by at least one generally U-shaped cutout.

10. The protective device of claim 6, further comprising at least one surface feature on an exterior surface of at least one of the extensions.

11. A protective cover for a bottle, comprising:

a base for receiving a bottom portion of a bottle;

a first strap extending longitudinally from the base, the first strap including a distal end for engaging a neck portion of the bottle;

a second strap extending longitudinally from the base, the second strap including a distal end for engaging the neck portion of the bottle;

wherein the first strap and the second strap are unconnected for a majority of a length of the bottle; and wherein the first strap, the first strap distal end, the second strap, the second strap distal end, and the base are integrally formed of a substantially elastic material.

12. The protective cover of claim 11, wherein the first strap, the second strap, and the base are constructed from at least one of a thermoplastic elastomer, silicone, rubber, thermoplastic rubber, and latex.

13. The protective cover of claim 11, wherein the distal end of the first strap and the distal end of the second strap each include an opening; and wherein, when installed on a bottle, one of the distal end of the first extension and the distal end of the second extension overlaps the other of the distal end of the first extension and the distal end of the second extension.

14. The protective cover of claim 13, wherein at least one of the openings is at least partially circumscribed by an enlarged rim.

15. The protective cover of claim 11, wherein the distal end of the first strap and the distal end of the second strap each include an opening for receiving the neck of the bottle; and wherein, when installed on the bottle, each of the distal end of the first strap and the distal end of the second strap substantially circumscribe the neck of the bottle.

16. The protective cover of claim 11, further comprising at least one surface feature on an exterior surface of at least one of the first strap and the second strap.

17. The protective cover of claim 11, wherein the first strap and the second strap are interposed by at least one generally U-shaped cutout.

* * * * *